US008151781B2

(12) United States Patent
Lykowski et al.

(10) Patent No.: US 8,151,781 B2
(45) Date of Patent: Apr. 10, 2012

(54) FLEXIBLE IGNITOR ASSEMBLY FOR AIR/FUEL MIXTURE AND METHOD OF CONSTRUCTION THEREOF

(75) Inventors: James D Lykowski, Temperance, MI (US); Keith Hampton, Ann Arbor, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 272 days.

(21) Appl. No.: 12/685,825

(22) Filed: Jan. 12, 2010

(65) Prior Publication Data

US 2010/0175653 A1 Jul. 15, 2010

Related U.S. Application Data

(60) Provisional application No. 61/143,994, filed on Jan. 12, 2009.

(51) Int. Cl.
*F02P 3/02* (2006.01)
*H01T 13/02* (2006.01)

(52) U.S. Cl. .. 123/608; 123/634; 123/635; 123/169 PH; 123/143 B

(58) Field of Classification Search ..... 123/608, 123/634, 635, 647, 169 PA, 169 PH, 143 B, 123/143 C, 169 CA, 169 EL
See application file for complete search history.

(56) References Cited

U.S. PATENT DOCUMENTS

| | | | | |
|---|---|---|---|---|
| 0,973,873 | A | | 10/1910 | Minogue |
| 0,991,226 | A | | 5/1911 | Mosler |
| 0,014,949 | A | | 9/1920 | Perron |
| 1,450,110 | A | | 3/1923 | Page |
| 1,784,541 | A | | 12/1930 | Rouillard |
| 2,550,358 | A | * | 4/1951 | Le Grand et al. ..... 174/77 S |
| 2,665,673 | A | * | 1/1954 | Woofter ..... 439/125 |
| 2,943,139 | A | * | 6/1960 | Skunda ..... 174/77 S |
| 3,025,425 | A | | 3/1962 | Logan |
| 4,073,565 | A | * | 2/1978 | Raymond ..... 439/777 |
| 4,413,870 | A | * | 11/1983 | Labutski, III ..... 439/11 |
| 4,797,115 | A | * | 1/1989 | Sturdevan et al. ..... 439/125 |
| 5,357,233 | A | * | 10/1994 | Wada ..... 336/107 |
| 5,371,436 | A | | 12/1994 | Griswold |
| 5,492,105 | A | * | 2/1996 | Nakajima et al. ..... 123/635 |
| 5,618,193 | A | * | 4/1997 | Nakajima et al. ..... 439/125 |
| 5,628,298 | A | * | 5/1997 | Murata ..... 123/635 |

(Continued)

FOREIGN PATENT DOCUMENTS

JP 01-267984 A 10/1989

(Continued)

*Primary Examiner* — Hai Huynh
(74) *Attorney, Agent, or Firm* — Robert L. Stearn; Dickinson Wright, PLLC

(57) ABSTRACT

An ignitor assembly constructed in accordance with one aspect of the invention has an upper inductor subassembly coupled to a lower firing end subassembly for relative pivot movement between the subassemblies. The upper inductor subassembly includes a tubular housing with inductor windings received therein with an upper electrical connector adjacent an upper end of the housing and a lower electrical connector adjacent a lower end of the housing. The lower firing end subassembly includes a ceramic insulator and a metal housing surrounding at least a portion of the ceramic insulator. The ceramic insulator has an electrical terminal extending from a terminal end and an electrode extending from a firing end. A flexible tube couples the upper inductor subassembly to the lower firing end subassembly and maintains the electrical terminal of the lower firing end subassembly in electrical contact with the lower electrical connector of the upper at a pivot joint.

13 Claims, 3 Drawing Sheets

U.S. PATENT DOCUMENTS 5,682,865 A * 11/1997 Maekawa et al. ..... 123/635
5,685,282 A * 11/1997 Murata et al. ..... 123/635
5,706,792 A * 1/1998 Boyer et al. ..... 123/634
5,971,776 A * 10/1999 Neel et al. ..... 439/125
6,273,733 B1 * 8/2001 Uchiyama ..... 439/125
6,358,072 B1 * 3/2002 Johnson ..... 439/126
6,617,769 B2 9/2003 Suzuki
6,703,770 B2 3/2004 Suzuki et al.
6,817,872 B1 11/2004 Berg
7,681,563 B2 * 3/2010 Idogawa et al. ..... 123/634
7,849,843 B2 * 12/2010 Kojima et al. ..... 123/635

FOREIGN PATENT DOCUMENTS

KR 1019980024497 A 7/1998
KR 101998-0044752 A 9/1998

* cited by examiner

FLEXIBLE IGNITOR ASSEMBLY FOR AIR/FUEL MIXTURE AND METHOD OF CONSTRUCTION THEREOF

CROSS-REFERENCE TO RELATED APPLICATION

This application claims the benefit of U.S. Provisional Application Ser. No. 61/143,994, filed Jan. 12, 2009, which is incorporated herein by reference in its entirety.

BACKGROUND OF THE INVENTION

1. Technical Field

This invention relates generally to ignitors used for igniting air/fuel mixtures in automotive application and the like.

2. Related Art

U.S. Pat. No. 6,883,507 discloses an ignitor for use in a corona discharge air/fuel ignition system. The ignitor is straight and is able to fit in ignitor openings that are straight. However, it is not able to accommodate a non-straight and/or a partially obstructed ignitor opening.

SUMMARY OF THE INVENTION

An ignitor assembly constructed in accordance with one aspect of the invention has an upper inductor subassembly including a tubular housing extending between an upper end and a lower end with inductor windings received therein and an upper electrical connector adjacent the upper end of the housing and a lower electrical connector adjacent the lower end of the housing. The upper electrical connector is configured in electrical communication with the lower electrical connector via the inductor windings. The ignitor assembly also has a lower firing end subassembly including a ceramic insulator and a metal housing surrounding at least a portion of the ceramic insulator. The ceramic insulator extends between a terminal end and a firing end with an electrical terminal extending from the terminal end in electrical contact with the lower electrical connector of the upper inductor subassembly. An electrode extends from the firing end of the ceramic insulator and is configured in electrical communication with the electrical terminal. The ignitor assembly further has a non-metal tube connecting the upper inductor subassembly to the lower firing end subassembly. The non-metal tube maintains the electrical terminal in electrical contact with the lower electrical connector. The non-metal tube has an intermediate region extending between the tubular housing of the upper inductor subassembly and the ceramic insulator. The intermediate region is circumferentially unconstrained from allowing relative pivotal movement between the electrical terminal and the lower electrical connector.

Accordingly, the intermediate region allows the flexible ignitor assembly to be freely disposed in bent, multi-axis or partially obstructed ignitor holes in a cylinder head of an engine. Further, designers of the cylinder head and overall ignition systems are free to utilize less space and introduce complex, partially obstructed, or multi-axes bores, if necessary, to house the ignitor assembly without concern for accommodating installation of the ignitor assembly along a straight path. The efficient utilization of available space in a cylinder head and throughout the ignition system, as a result of the flexible ignitor assembly, contributes to a decrease in the size, weight and cost of the overall engine.

In accordance with another aspect of the invention, a method of constructing an ignitor assembly is provided. The method includes forming a lower firing end subassembly having a ceramic insulator and a metal housing surrounding at least a portion of the ceramic insulator with an electrical terminal extending from a terminal end of the insulator and an electrode extending from a firing end of the insulator. Further, forming an upper inductor subassembly having a tubular housing extending between an upper end and a lower end with inductor windings received in the housing and having an upper electrical connector adjacent the upper end and a lower electrical connector adjacent the lower end with the lower electrical connector being axially biased relative to the tubular housing by a spring member. Then, coupling the lower end of the upper inductor subassembly housing to the terminal end of the ceramic insulator of the lower firing end subassembly with a non-metal tube and maintaining an intermediate region of the non-metal tube circumferentially unconstrained to allow relative pivotal movement between the electrical terminal and the lower electrical connector.

BRIEF DESCRIPTION OF THE DRAWINGS

These and other aspects, features and advantages of the invention will become more readily appreciated when considered in connection with the following detailed description of presently preferred embodiments and best mode, appended claims and accompanying drawings, in which:

DETAILED DESCRIPTION OF A PREFERRED EMBODIMENT

Figure 1:
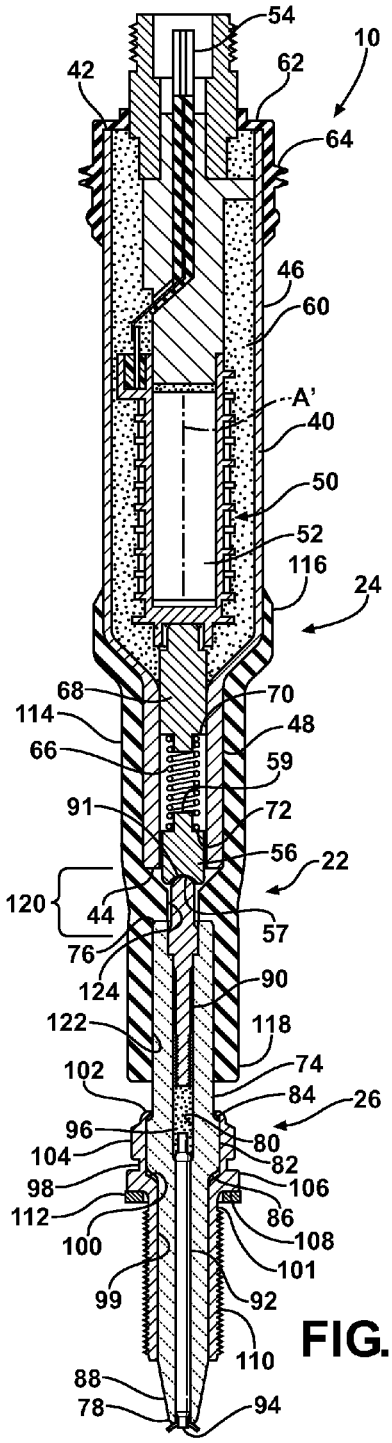
FIG. 1 is a cross-sectional view of an ignitor assembly constructed according to one presently preferred embodiment of the invention.
Figure 2:
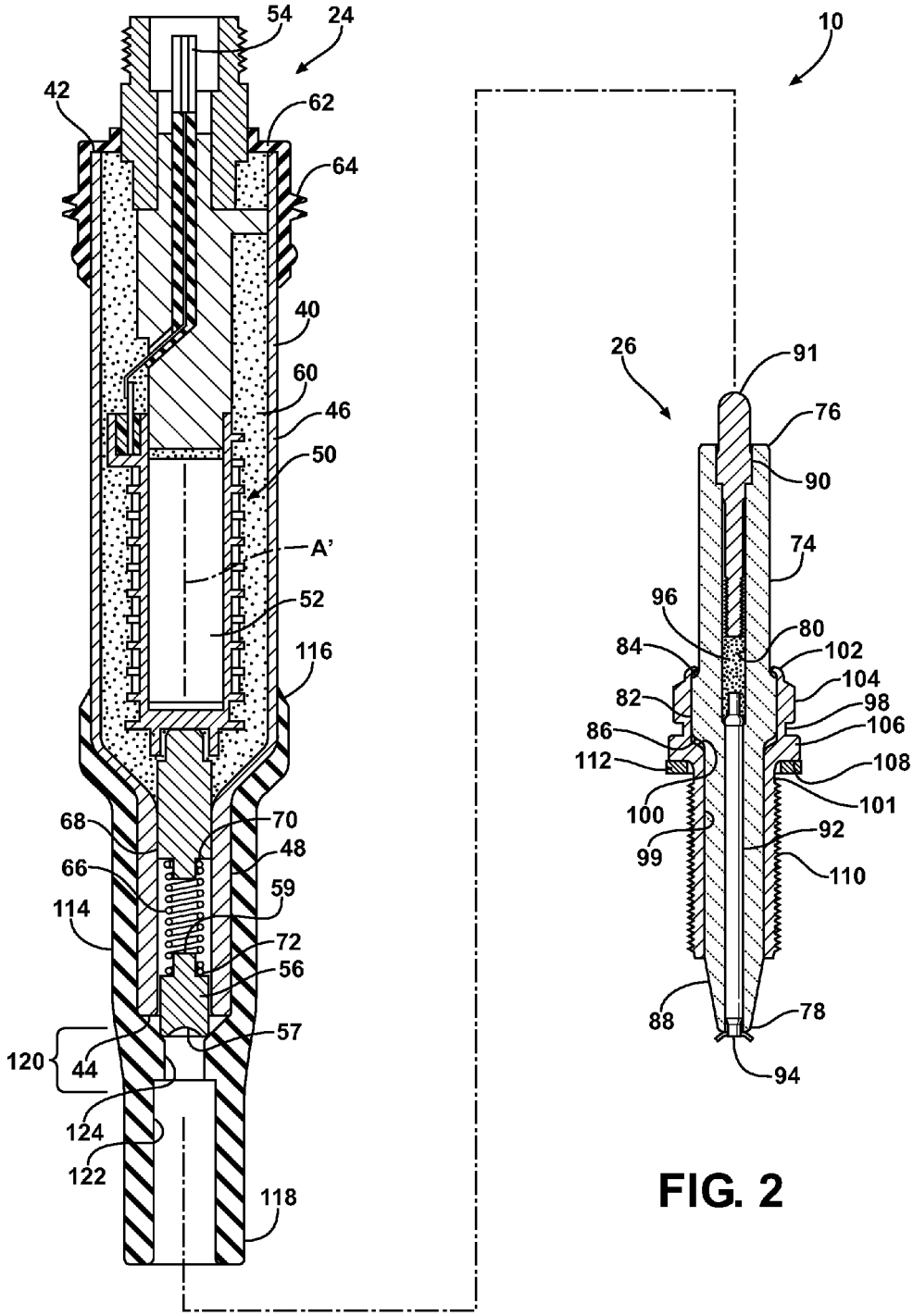
FIG. 2 is an exploded view of the ignitor assembly of FIGS. 1 and 1A showing a lower firing end of the ignitor assembly separated from an upper inductor end of the ignitor assembly.
Figure 3:
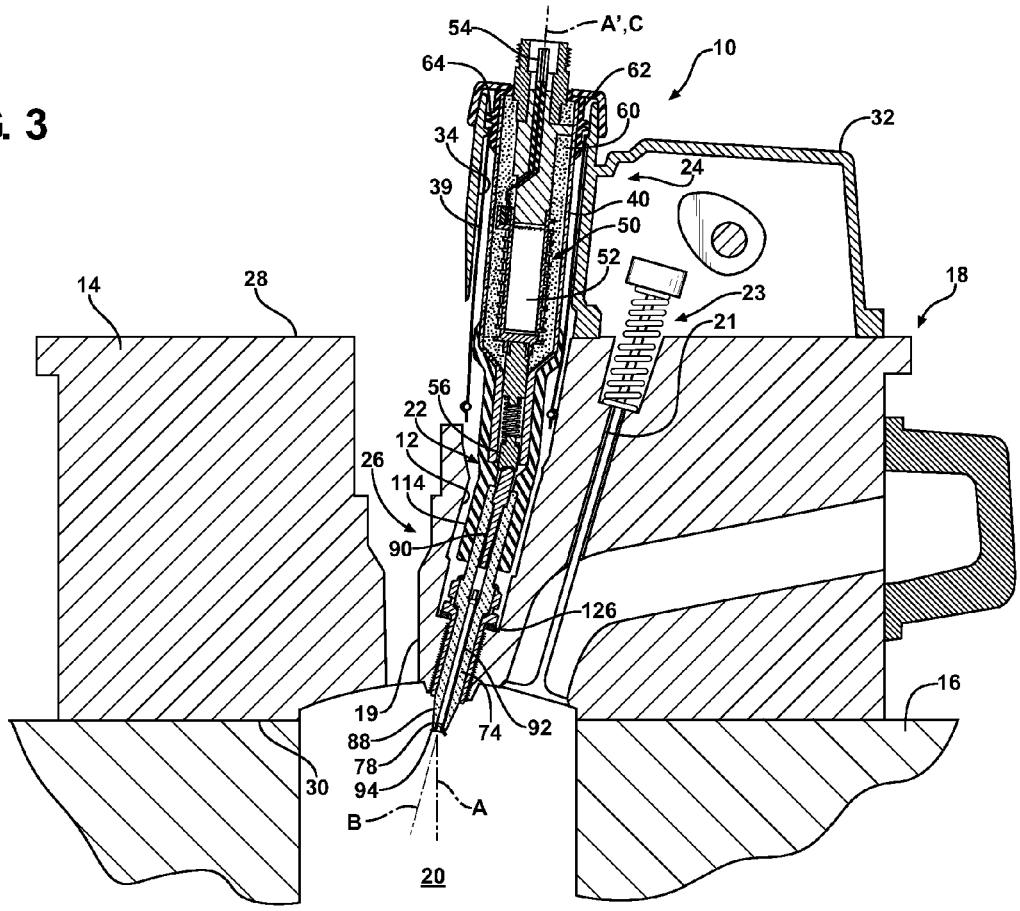
FIG. 3 is a cross-sectional view of the ignitor assembly of FIG. 1 shown in installed within an internal combustion engine.

FIGS. 1-3 show an ignitor assembly, represented as a corona discharge ignitor assembly, and referred to hereafter as assembly 10, constructed in accordance with one aspect of the invention. As shown in FIG. 3, the assembly 10 is constructed to be mounted within an ignitor bore 12 of a cylinder head 14 that is configured to be joined to an engine block 16 of an internal combustion engine 18. The engine block 16 includes a combustion cylinder 20 in which a piston (not shown) reciprocates. The engine 18 may have a plurality of such combustion cylinders 20 and associated pistons. The ignitor bore 12 can be constructed to extend along a straight axis, or, if desired, along multiple non-parallel axes, such as may be desired to route around other adjacent engine features, such as a fuel injector bore 19 in which a fuel injector head (not shown) is received for injecting a fuel/air mixture into the combustion cylinder 20 and/or a valve bore 21 in which a valve assembly 23 is received, for example. Regardless, the assembly 10 is constructed to flex at a bend joint, also referred to as pivot joint 22, and thus, is able to freely attain a bent configuration, as needed and desired. Accordingly, the assembly 10 is able accommodate a curved and/or partially obstructed ignitor bore 12 and otherwise allows an upper inductor subassembly 24 to pivot relative to a lower firing end subassembly 26.

The cylinder head 14 is formed with at least one of the ignition bores 12 associated with each combustion cylinder 20. The ignition bore 12 extends from an upper surface 28 of the head 14 to a lower surface 30 and is in open communication with the associated combustion cylinder 20. The bore 12 can extend along an axis A that is transverse or substantially transverse to the upper surface 28 or it can extend along an axis B that is inclined at an oblique angle to the upper surface 28, or both. Regardless, the assembly 10 is able to accommodate an inclination between the axes A and B without impacting the functionality of the assembly 10. In addition, the ignition bore 12 may be positioned and routed immediately adjacent other features of the engine 18, such as a fuel injection bore, for example.

The engine 18 has a cylinder head cover, also referred to as a valve cover 32, bolted or otherwise secured to the cylinder head 14. The cover 32 has an opening 34 to accommodate the ignitor assembly 10, such that an electrical wire or source of power can be readily attached to the ignitor assembly 10. The opening 34 can be positioned and centered along the axis B of the lower firing end subassembly 26, or it could be located off center from the axis B, such as along axis C, if desired. The opening 34 can be constructed as an integral cylindrical passage with the valve cover 32, as shown, or a it can be provided via a separate tubular sleeve for fixed and sealed receipt with an upper surface 38 of the valve cover 32 and being brought into sealed engagement with the upper surface 28 of the cylinder head 14. In addition, a separate tubular shield 39 can be disposed about a portion of the assembly 10 to facilitate protecting the assembly 10 from exposure to oil within the valve cover 32. Accordingly, the opening 34 or sleeve 36 provides a mechanism to fix the upper inductor subassembly 24 in position relative to the lower firing end subassembly 26 that is fixed in the bore 12 of cylinder head 14, and further, keeps the upper inductor subassembly 24 free from any undesired exposure to lubricant.

Figure 1A:
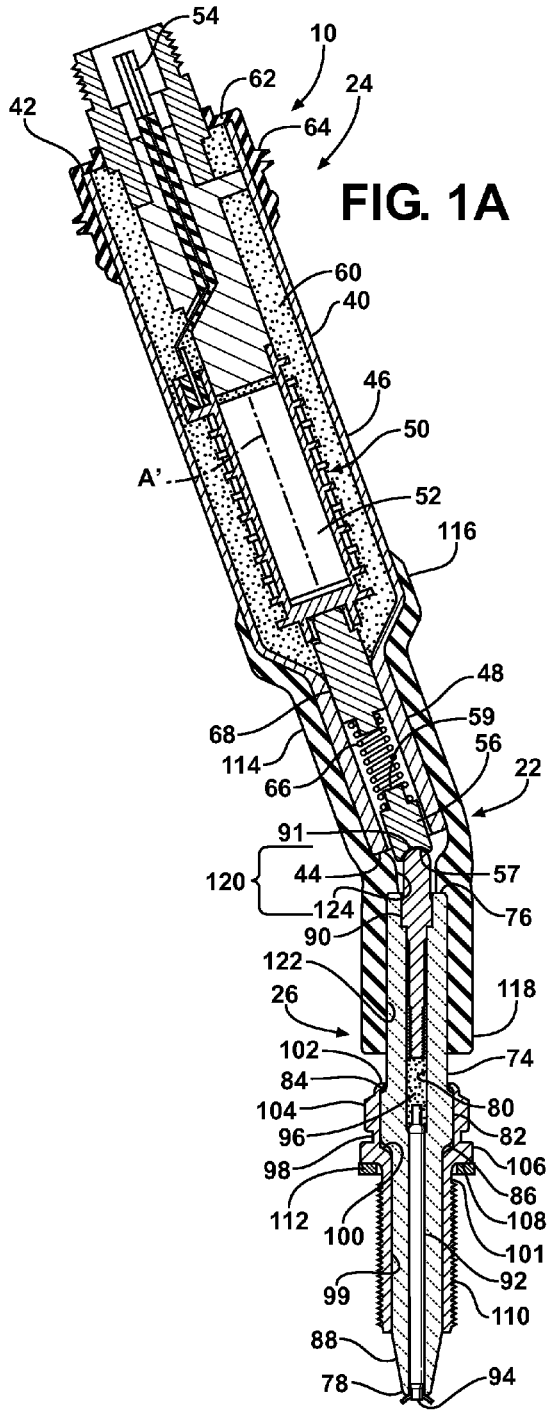
FIG. 1A is a view of the ignitor assembly of FIG. 1 shown bent at a pivot joint of the ignitor assembly.

As best referenced in FIGS. 1, 1A and 2, the upper inductor subassembly 24 includes a metal tubular housing 40 that extends along a first axis A' between an upper end 42 and a lower end 44. The housing 40 is shown here as having an enlarged diameter upper portion 46 and a lower portion 48 that is reduced in diameter from the upper portion 46. The upper portion 46 is sized appropriately to receive the desired configuration of inductor windings, also referred to as a coil 50, of both high and low voltage inductor windings. The coil 50 is wound about a central ferromagnetic core 52 and is in electrical communication with an upper electrical connector 54 adjacent the upper end 42 of the housing 40 and a lower electrical connector 56 adjacent the lower end 44 of the housing 40.

The housing 40 is either filled with a pressurized gas or resin 60 about the coil 50 and the housing 40 for high voltage suppression. The resin 60 fills or substantially fills any voids within the upper portion 46 of the housing 40. A polymeric or rubber cap 62 extends circumferentially about the upper end 42 of the housing 40 and is shown as having annular projections or ribs 64 extending radially outwardly from the housing 40 to facilitate fixing and forming a seal between the housing 40 and the cylinder head cover 32.

The lower electrical connector 56 is constructed of a suitable conducting metal material and is sized having a cylindrical shape for close plunging movement within the lower portion 48 of the housing 40. Accordingly, the cylindrical lower electrical connector 56 has a slightly reduced outer diameter from the inner diameter of the lower portion 48, thereby providing a loose fit therebetween. The lower electrical connector 56 extends outwardly from the lower end 44 of the housing 40 to a free end 57 having a concave surface. An opposite end 59 of the connector 56 is brought into electrical communication with the coil 50 via a spring member 66 and an intermediate conductor 68. As such, both the spring member 66 and the intermediate conductor 68 are constructed from a suitable metal material. The spring member 66 is represented here as being a coil spring member, though other spring configurations are contemplated to be within the scope of the invention. The intermediate conductor 68 is fixed to the coil 50, such as by way of interference fit within the lower portion 48 and/or via the resin 60. The spring member 66 has one end 70 configured in electrical communication with the intermediate conductor 68 and another end 72 configured in electrical communication with the lower electrical connector 56. The end 70 can be fixed to the intermediate conductor 68, such as by being attached or snapped over an end of the conductor 68 and the end 72 can be fixed to the lower electrical connector 56, such as by being attached or snapped over an end of the connector 56. As such, the lower electrical connector 56, though able to slide freely in the lower portion 48 of the housing 40, can be held and maintained from falling freely out of the lower portion 48 by the spring member 66, if desired.

The lower firing end subassembly 26 includes an elongate ceramic insulator 74 extending between an upper terminal end 76 and a lower firing end 78 with central through passage 80 extending therebetween. The insulator 74 has an enlarged diameter intermediate section 82 providing radially outwardly extending upper and lower shoulders 84, 86, respectively. The insulator 74 also has a tapered nose 88 converging to the firing end 78. An electrical terminal 90 is received within the central through passage 80 and extends from the terminal end 76 of the bore 56 to a free end 91, shown as being convex, for pivotal electrical communication with the lower electrical connector 56 of the upper inductor subassembly 24. A central electrode 92 is received within the central through passage 80 and extends from the firing end 78 to a free discharge end 94 which, when the ignitor assembly 10 is installed in the cylinder head 14, projects into the combustion cylinder 20 of the engine 18. The terminal 90 and the central electrode 92 are configured in electrical communication with one another, such as via a resistor layer 96 made from any suitable composition used in such applications to suppress electromagnetic interference ("EMI").

The lower firing end subassembly 26 further includes an outer metal jacket, also referred to as housing or shell 98. The shell 98 surrounds at least a portion of the ceramic insulator 74 in fixed relation thereto. To facilitate fixing the shell 98 to the insulator 74, the shell 98 has an inner surface 99 shaped to receive the insulator 74 therein with an inner shoulder 100 configured to abut the lower shoulder 86 of the insulator intermediate section 82 and an uppermost lip 102 that is curled, rolled, or otherwise folded over the upper shoulder 84 of the insulator intermediate section 82 to capture the intermediated section 82 between the shoulder 100 and the lip 102. The shell 98 may be provided with an external hexagonal tool receiving member 104 or other feature for removal and installation of the lower firing end subassembly 26 in the ignitor bore 12. The feature size will preferably conform with an industry standard tool size of this type for the related application. Of course, some applications may call for a tool receiving interface other than a hexagon, such as slots to receive a spanner wrench, or other features such as are known in racing spark plug and other applications. The shell 98 also has an annular flange 106 extending radially outwardly from an outer surface 101 of the shell 98 to provide an annular, generally planar sealing seat 108 from which a threaded region 110 depends. The sealing seat 108 may be paired with a gasket 112 to facilitate a hot gas seal of the space between the outer surface 101 of the shell 98 and the threaded bore in the ignitor bore 12. Alternately, the sealing seat 108 may be configured as a tapered seat located along the lower portion of the shell 98 to provide a close tolerance and a self-sealing installation in a cylinder head which is also designed with a mating taper for this style of spark plug seat.

The lower firing end subassembly 26 is connected to the upper inductor subassembly 24 by an intervening flexible tube 114, such as a non-metal tube of polymeric material, such as silicone, or other suitable types of rubber, for example. The tube 114 has an upper end 116 attached to the housing 40 of the upper inductor subassembly 24 and an opposite lower end 118 attached to the ceramic insulator 74 with an intermediate region 120 extending between the tubular housing 40 of the upper inductor subassembly 24 and the ceramic insulator 74. A through passage 122 extends axially between the ends 116, 118. The through passage 122 has a radially inwardly extending annular protrusion, also referred to as constriction 124, sized to restrict or inhibit the passage of the lower electrical connector 56 therethrough. The constriction 124 is located within the intermediate region 120 of the tube 114. As such, the constriction 124 facilitates maintaining the upper inductor subassembly 24 in an assembled state prior to attachment to the lower firing end subassembly 26 by maintaining the lower electrical connector 56 within the tube 114 against the bias imparted by the spring member 66. As discussed further hereafter, the intermediate region 120 is circumferentially unconstrained to allow relative pivotal movement between the electrical terminal 90 and the lower electrical connector 56.

In accordance with one method of constructing and assembling the ignitor assembly 10 in the engine 18, the lower firing end subassembly 26 is first threaded into the ignitor bore 12 of the cylinder head 14. While threading the threaded region 110 of the shell 98 into the ignitor bore 12, the sealing seat 108 is brought into sealed engagement with a sealing surface 126 in the ignitor bore 12. Then, upon fixing the lower firing end subassembly 26 into the ignitor bore 12, the upper inductor subassembly 24 is attached to the lower firing end subassembly 26, either prior to fastening the cylinder head cover 32 to the cylinder head 14 or after. Regardless of when the cylinder head cover 32 is fixed to the cylinder head 14, the upper inductor subassembly 24 is disposed in the ignitor bore 12, thereby disposing the lower end 118 of the flexible tube 114 over the terminal end 76 of the insulator 74. As the tube 114 is sliding over the insulator 74, the convex free end 91 of the terminal 90 is received through the constriction 124 of the tube 114 and brought into direct electrical contact with the concave free end 57 of the lower electrode connector 56. The lower electrode connector 56 is free to plunge axially against the bias of the spring member 66 to accommodate assembly of the upper inductor subassembly 24 to the lower firing end subassembly 26, and thus, moves axially out of engagement and away from the constriction 124 as necessary to complete the assembly. In order to allow relative pivotal movement between the upper inductor subassembly 24 and the lower firing end subassembly 26, it is desirable to maintain the free end 57 of the lower electrode connector 56 axially outward from the lower end 44 of the housing 40, or immediately adjacent thereto.

Upon being fully assembled, the convex free 91 and the concave free end 57 are radially aligned with the unconstrained intermediate region 120 of the tube 114 to form the pivot joint 22, wherein the pivot joint 22 is able to be freely pivoted, such as in a ball and socket type joint.

It should be understood that depending upon space and access requirements and limitations, there are a number of different ways that the ignitor assembly 10 can be assembled and secured in position within the ignitor bore 12. For example, the lower end of the jacket 54 can be threaded to allow the ignitor assembly 10 to be screwed into a blind threaded region of the ignitor bore 12, as discussed or the ignitor could be provided with suitable clamps and/or fasteners to enable the ignitor to be secured to the cylinder head 14 at or near its upper surface. As noted, the valve cover 32 can be installed either before or after installation of the ignitor assembly 10, depending upon the particular routing and fastening requirements. Accordingly, the particular fastening technique is less important to this invention and any of a number of ways are contemplated for securing the assembly 10 in place, including and in addition to those shown and described.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. An ignitor assembly for an internal combustion engine fuel/air ignition system, comprising:

an upper inductor subassembly having a tubular housing extending between an upper end and a lower end with inductor windings received in said housing between said upper and lower ends and having an upper electrical connector adjacent said upper end of said housing and a lower electrical connector adjacent said lower end of said housing, said upper electrical connector being configured in electrical communication with said lower electrical connector via said inductor windings;

a lower firing end subassembly having a ceramic insulator and a metal housing surrounding at least a portion of said ceramic insulator, said ceramic insulator extending between a terminal end and a firing end with an electrical terminal extending from said terminal end in electrical contact with said lower electrical connector and an electrode extending from said firing end, said electrode being configured in electrical communication with said electrical terminal; and a non-metal tube connecting said upper inductor subassembly to said lower firing end subassembly and maintaining said electrical terminal in electrical contact with said lower electrical connector, said non-metal tube having an intermediate region extending between said tubular housing of said upper inductor subassembly and said ceramic insulator, said intermediate region being circumferentially unconstrained to allow relative pivotal movement between said electrical terminal and said lower electrical connector.

2. The ignitor assembly of claim 1 wherein said non-metal tube has one end attached to said tubular housing of said upper inductor subassembly and an opposite end attached to said ceramic insulator with a through passage extending axially between said one end and said opposite end, said through passage having a constriction restricting passage of said lower electrical connector.

3. The ignitor assembly of claim 2 wherein said electrical terminal extends through said constriction.

4. The ignitor assembly of claim 2 further comprising a spring member biasing said lower electrical connector outwardly at least in part from said lower end of said tubular housing of said upper inductor subassembly.

5. The ignitor assembly of claim 2 wherein said constriction is in said intermediate region of said non-metal tube.

6. The ignitor assembly of claim 1 wherein said metal housing of said lower firing end subassembly has an external threaded region and an annular seat extending radially outwardly relative to said external threaded region.

7. The ignitor assembly of claim 1 wherein said non-metal tube has a high dielectric strength.

8. The ignitor assembly of claim 1 wherein said non-metal tube is bonded to said tubular housing of said upper inductor subassembly and press fit on said ceramic insulator.

9. A method of constructing an ignitor assembly, comprising:

providing a lower firing end subassembly having a ceramic insulator and a metal housing surrounding at least a portion of the ceramic insulator with an electrical terminal extending from a terminal end of the insulator and an electrode extending from a firing end of the insulator;

providing an upper inductor subassembly having a tubular housing extending between an upper end and a lower end with inductor windings received in the housing and having an upper electrical connector adjacent the upper end and a lower electrical connector adjacent the lower end with the lower electrical connector being axially biased relative to the tubular housing by a spring member; and coupling the lower end of the upper inductor subassembly housing to the terminal end of the ceramic insulator of the lower firing end subassembly with a non-metal tube and maintaining an intermediate region of the non-metal tube circumferentially unconstrained to allow relative pivotal movement between the electrical terminal and the lower electrical connector.

10. The method of claim 9 further including biasing the lower electrical connector into electrical contact with the electrical terminal with a spring member.

11. The method of claim 10 further including moving the lower electrical connector axially against the bias of the spring member while bringing the electrical terminal into electrical contact with the lower electrical connector.

12. The method of claim 10 further including providing the intermediate region of the non-metal tube with a constriction having a diameter less than a diameter of the lower electrical connector.

13. The method of claim 12 further including biasing the lower electrical connector into abutment with the constriction prior to coupling the lower end of the upper inductor subassembly housing to the terminal end of the ceramic insulator of the lower firing end subassembly.

* * * * *